US012611705B2

(12) United States Patent
Wedrychowicz

(10) Patent No.: US 12,611,705 B2
(45) Date of Patent: Apr. 28, 2026

(54) PUNCH, A SEMI-FINISHED CAN, AND A CAN MANUFACTURED WITH USE OF THE SAID PUNCH

(71) Applicant: CANPACK S.A., Cracow (PL)

(72) Inventor: Przemyslaw Wedrychowicz, Cracow (PL)

(73) Assignee: Canpack S.A., Cracow (PL)

( * ) Notice: Subject to any disclaimer, the term of this patent is extended or adjusted under 35 U.S.C. 154(b) by 0 days.

(21) Appl. No.: 18/685,226

(22) PCT Filed: Aug. 17, 2022

(86) PCT No.: PCT/IB2022/057702

§ 371 (c)(1),
(2) Date: Feb. 20, 2024

(87) PCT Pub. No.: WO2023/021436

PCT Pub. Date: Feb. 23, 2023

(65) Prior Publication Data

US 2024/0342783 A1 Oct. 17, 2024

(30) Foreign Application Priority Data

Aug. 20, 2021 (PL) ..... 438791

(51) Int. Cl.
*B21D 22/28* (2006.01)
*B21D 51/26* (2006.01)
*B65D 8/00* (2006.01)

(52) U.S. Cl.
CPC ..... *B21D 22/28* (2013.01); *B21D 51/26* (2013.01); *B65D 7/04* (2013.01)

(58) Field of Classification Search
CPC ..... B21D 22/21; B21D 22/28; B21D 22/283; B21D 51/26
See application file for complete search history.

(56) References Cited

U.S. PATENT DOCUMENTS 3,406,554 A * 10/1968 Frankenberg ..... B21D 45/06 72/344
3,785,311 A * 1/1974 Yoshikawa ..... B65D 1/12 72/348

(Continued)

FOREIGN PATENT DOCUMENTS

EP 0045115 A1 2/1982
EP 2035166 B1 4/2014

(Continued)

OTHER PUBLICATIONS

Application No. CONC2024/0003032 , Office Action, Mailed On Oct. 15, 2024, 8 pages.

(Continued)

*Primary Examiner* — Edward T Tolan
(74) *Attorney, Agent, or Firm* — Kilpatrick Townsend & Stockton LLP

(57) ABSTRACT

A punch for drawing beverage cans comprising a cylindrical body with a separated region (1) forming a can side wall having diameter D1, a step (2), and a region (3) forming a thick wall, characterized in that, the region (3) forming thick wall starts from the step (2), and the diameter D2 of the punch in this region (3) is variable and is smaller than the diameter D1 of the region (1) forming can's sidewall. The object of the invention is also a beverage can in the form of a semi-finished can, and a finished beverage can manufactured with use of the said punch.

9 Claims, 5 Drawing Sheets

(56) References Cited

U.S. PATENT DOCUMENTS

Figure 1:
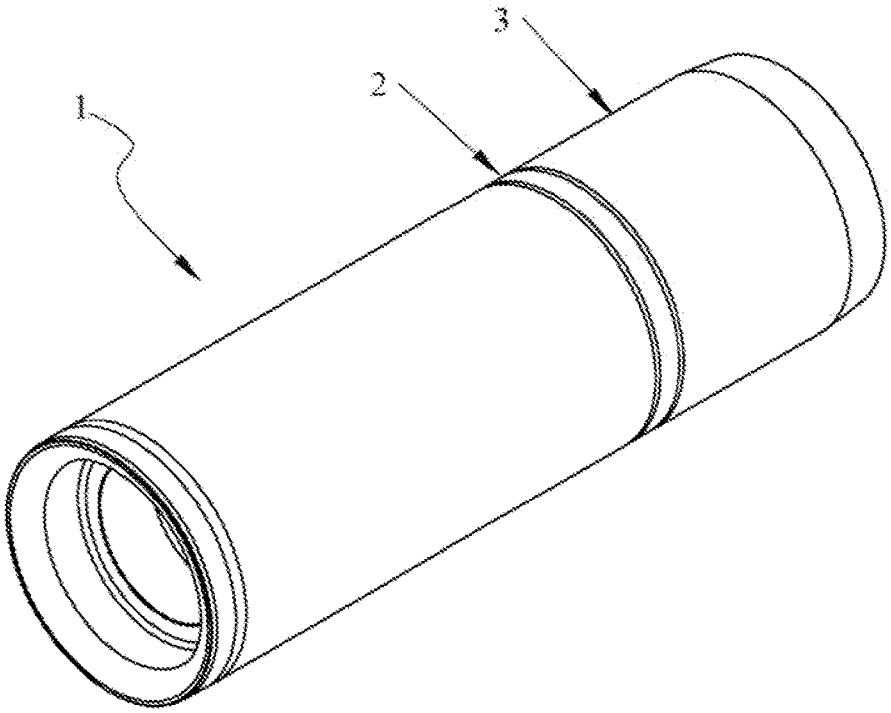

| | | | | |
|---|---|---|---|---|
| 3,951,296 | A * | 4/1976 | Swanson | B21D 22/30 220/672 |
| 4,036,047 | A * | 7/1977 | Miller | B21D 22/28 72/347 |
| 5,181,409 | A | 1/1993 | Heyes et al. | |
| 9,566,630 | B2 | 2/2017 | Sines | |
| 10,589,334 | B2 | 3/2020 | Butcher et al. | |
| 2006/0266092 | A1 | 11/2006 | Kawai et al. | |
| 2017/0001231 | A1* | 1/2017 | Sines | B21D 51/26 |

FOREIGN PATENT DOCUMENTS

| | | | |
|---|---|---|---|
| JP | 6352721 | A | 3/1988 |
| JP | 2008132522 | A | 6/2008 |
| JP | 2009078303 | A | 4/2009 |
| JP | 2009082989 | A | 4/2009 |
| JP | 2011006087 | A | 1/2011 |
| JP | 2013208652 | A | 10/2013 |
| JP | 2018154407 | A | 10/2018 |
| WO | 9617700 | A2 | 6/1996 |
| WO | 2009100972 | A1 | 8/2009 |
| WO | 2011128347 | A1 | 10/2011 |

OTHER PUBLICATIONS

Application No. CONC2024/0003032 , Office Action, Mailed on Mar. 31, 2025, 9 pages.

* cited by examiner

PUNCH, A SEMI-FINISHED CAN, AND A CAN MANUFACTURED WITH USE OF THE SAID PUNCH

CROSS-REFERENCE TO RELATED APPLICATIONS

This application is a 371 National Stage filing of PCT Application No. PCT/IB2022/057702, filed Aug. 17, 2022, which claims priority to PL Patent Application No. P.438791, filed Aug. 20, 2021, which are incorporated by reference herein in their entirety.

TECHNICAL FIELD

The object of the present invention is a new punch for drawing beverage cans, a can in the form of a semi-finished can and a finished can manufactured with use of the said punch.

BACKGROUND ART

Two-piece aluminum cans are manufactured by the DWI, method of drawing and wall ironing, using, inter alia, a horizontal press (bodymaker). In the first stage, the aluminum cup that goes to the horizontal press is drawn to the desired diameter of the can, and then it is ironing through the series of tools, where the thickness of the body/wall is reduced until the designed wall thickness and height of the can are achieved.

The last stage of shaping on a horizontal press is forming the bottom. Then the can is transferred to the trimmer in order to correct the height by cutting the uneven upper edge. After the washing process, the can goes to the printer, oven, spraying the internal varnish and back to the oven. The final shape of the can is created in a multi-stage operation of necking and forming the flange.

Recent years of beverage can development focused on reducing its weight, improving strength parameters and improving the DWI process. Various approaches to this issue are available in the literature, from changing the bottom profile, through changing the roughness of the semi-finished can or raw (input) material to modifying the geometry of the tools.

Patent specification EP2035166B1 provides an expansion die for manufacturing metal containers including a work surface adapted to progressively expanding a diameter of a metal container. The die described in that specification allows for obtaining a unique shape of a can.

Patent specification U.S. Pat. No. 9,566,630B2 discloses a punch for forming aluminum cans, which comprises at least two regions of different surface textures. The new surface of the punch allows for reduction of defects arising during the DWI process.

Unexpectedly, it turned out, that it is possible, by modifying the shape of the punch, to obtain a can with a reduced weight by reducing the thickness of the material in the region of its neck.

DISCLOSURE OF THE INVENTION

A punch for drawing beverage cans comprising a cylindrical body with a separated region forming a can body having diameter D1, a step, and a region forming a thick wall according to the present invention is characterized in that, the region forming thick wall starts from the step, and the diameter D2 of the punch in this region is variable and is smaller than the diameter D1 of the region forming can's sidewall.

Preferably the region forming a thick wall of the can comprises two forming sections, where the first section has length from 0.01 to 40 mm, and the second section has length from 0.1 to 30 mm.

Preferably the region forming a thick wall of the can comprises three forming sections, where the first section has length from 0.05 to 40 mm, the second section has length from 0.01 to 40 mm, and the third section has length from 0.1 to 30 mm.

Preferably the region forming a thick wall of the can comprises three forming sections, where the first section has length from 0.01 to 40 mm, the second section has length from 0.1 to 30 mm, and the third section has length from 0.1 to 30 mm.

Preferably the region forming a thick wall of the can comprises four forming sections, where the first section the first section has length from 0.05 to 40 mm, the second section has length from 0.01 to 40 mm, the third section has length from 0.1 to 30 mm, and the fourth section has length from 0.1 to 30 mm.

Preferably the region forming a thick wall of the can has length smaller than 100 mm.

Preferably the diameter D2 of the punch in the region forming the thick wall of the can is in the range 29.7 to 99.9 mm, while the diameter D1 of the punch in the region forming the can sidewall is in the range from 30 to 100 mm.

Preferably the diameter D2 of the punch in the region forming the thick wall of the can is smaller than the diameter D1 of the punch in the region forming the can sidewall by at least 10 μm.

Preferably the step has length from 0.1 to 40 mm, height from 1 to 500 μm, and an angle in relation to the axis of the punch from 1 to 80 degrees.

Preferably the diameter of the punch in the region forming the thick wall of the can varies linearly or/and non-linearly.

A beverage can in the form of a semi-finished can intended for the operation of necking according to the present invention is characterized in that, it has a thick wall of variable thickness t22, t23 ranging from 80 to 220 μm.

Preferably the thickness of the can body t24 is within the range from 80 to 200 μm.

Preferably the thickness t22 is smaller than t23, the thickness t22 and t23 is smaller than t21, the thickness t24 is smaller than t21.

A finished beverage can according to the present invention is characterized in that, it has a neck (9) having wall thickness t41, t42 and t43 comprising in the range from 80 to 220 μm.

Preferably the wall thickness t41=t42=t43.

Preferably the wall thickness t43 is bigger than the wall thickness t41.

The term "variable diameter" means that the diameter of the punch in the region forming the thick wall is not constant, but changes by increasing or decreasing, which results in the fact that the outer profile of the punch does not extend along the entire length of the area forming the thick wall of the can in a straight line parallel to the punch axis, but can be described by a curved and/or broken line (concave and/or convex function), wherein on some sections, the profile may run in a straight line parallel to the punch axis. A profile selected in this way changes the way the material is formed and affects the final shape and a thick wall thickness of a can after the DWI process. The curvature of individual areas is selected for the design of the can, it differs depending on the thickness of the (input) raw aluminum sheet, diameter, height and shape of the can's neck. The punch can be made of carbon steel, stainless steel, carbides, ceramics and/or a composite material and/or plastic.

The thick wall of the can is a fragment of the semi-finished can in its upper part, which in the process of necking takes the shape of the neck in the final product. The prior art thick wall has a uniform thickness, as for example in WO2020117641A1. Meanwhile, a can in the form of a semi-finished product before the process of necking and forming the neck, manufactured with the use of punch according to the invention, is characterized by a variable thickness of the thick wall. Preferably, the thick wall is thinned in its middle part.

A can made of this semi-finished can is characterized by a lower weight, obtained by reducing the thickness in the upper part of the can, in the neck area. The can, with such a wall in the neck area, is also characterized by lower material consumption, at the same time meets the quality requirements and enables the production of a double seam ensuring proper connection of the can end.

The beverage can according to the invention can be manufactured from aluminum or steel alloys, possibly from other metal alloys.

EXAMPLES

Figure 2:
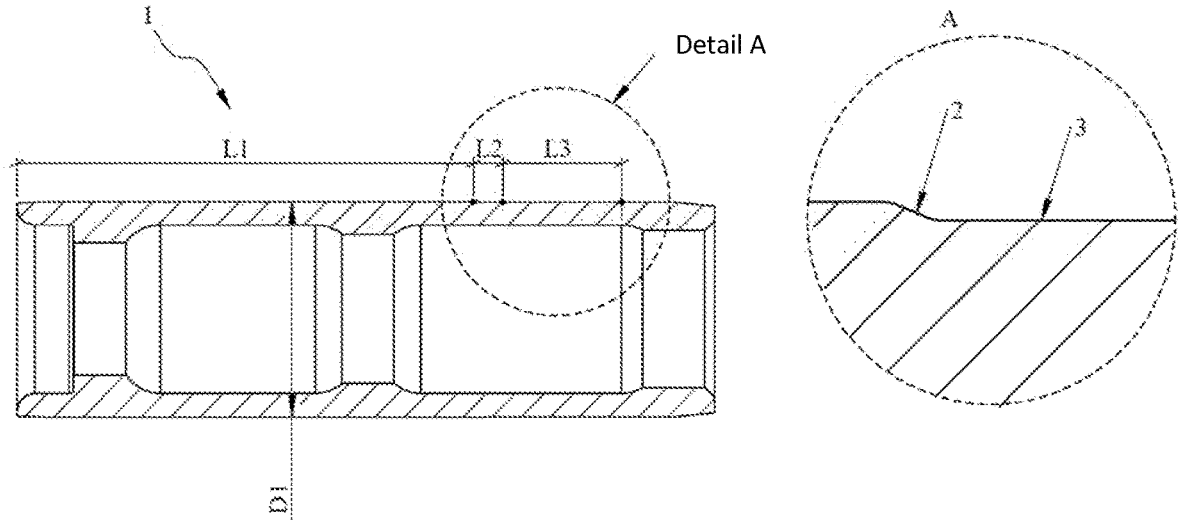
Figure 3:
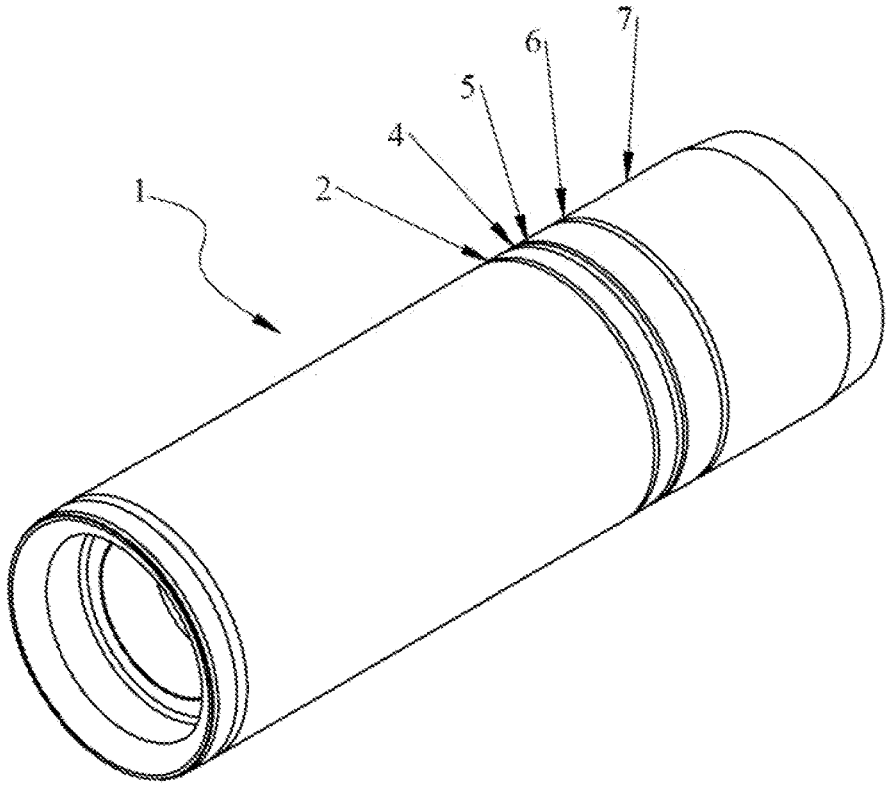
Figure 6:
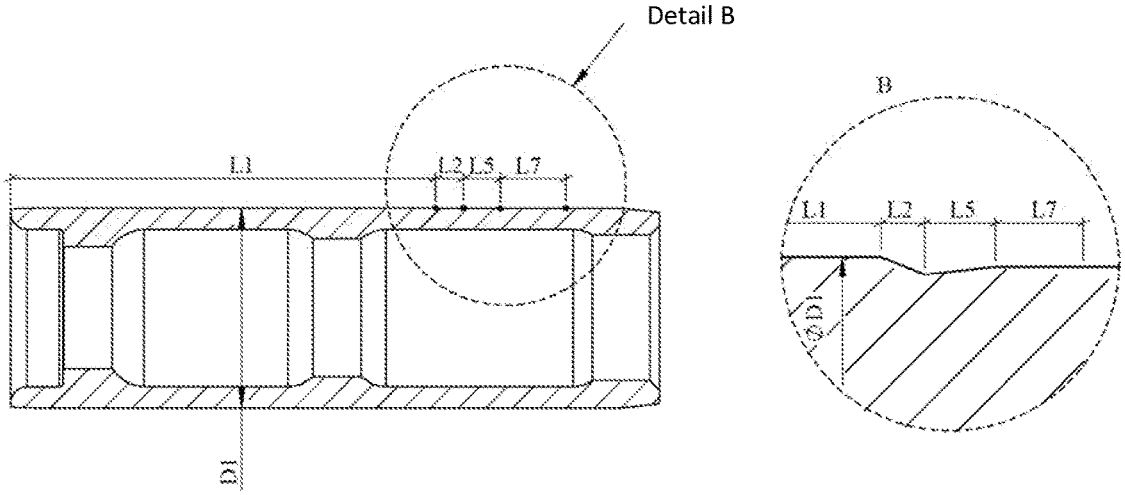
Figure 7:
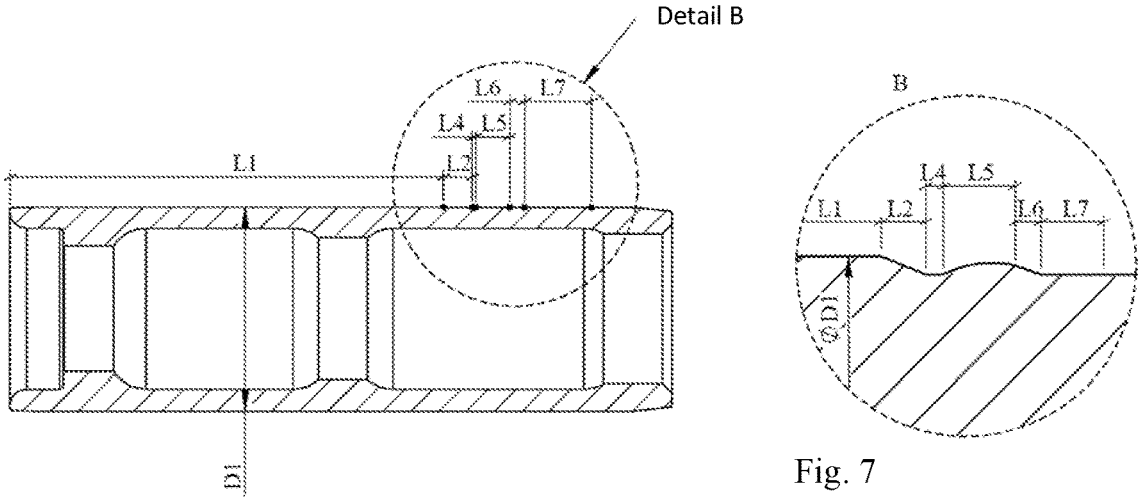
Figure 8:
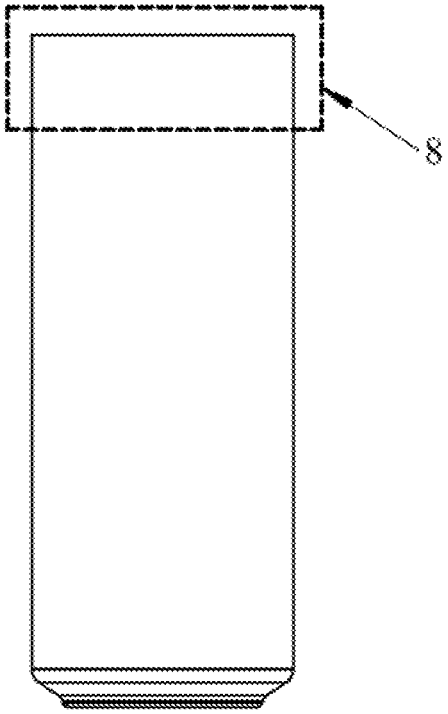
Figure 9:
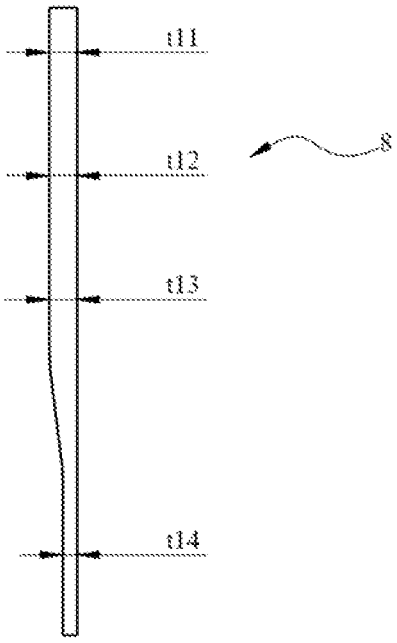
Figure 10:
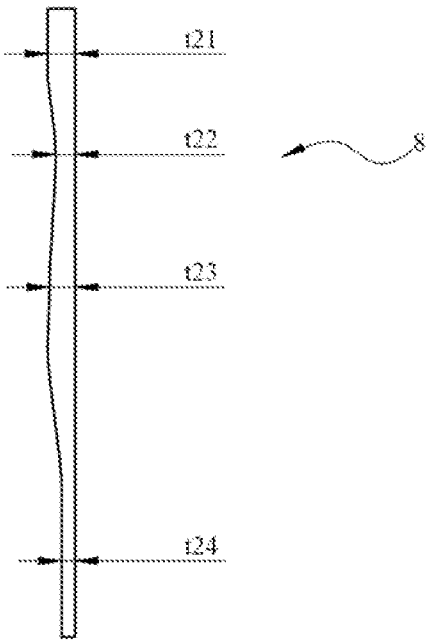
Figure 11:
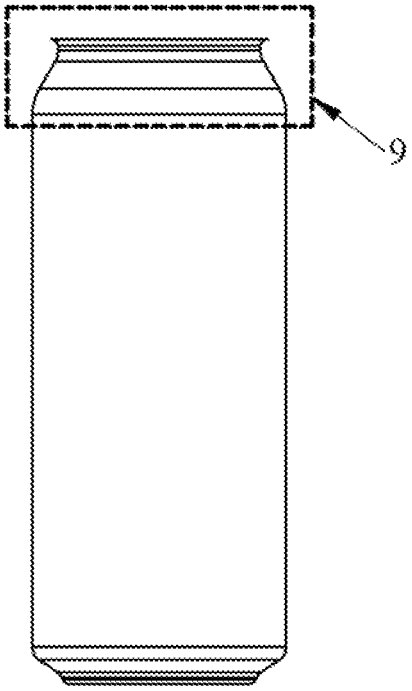
Figure 12:
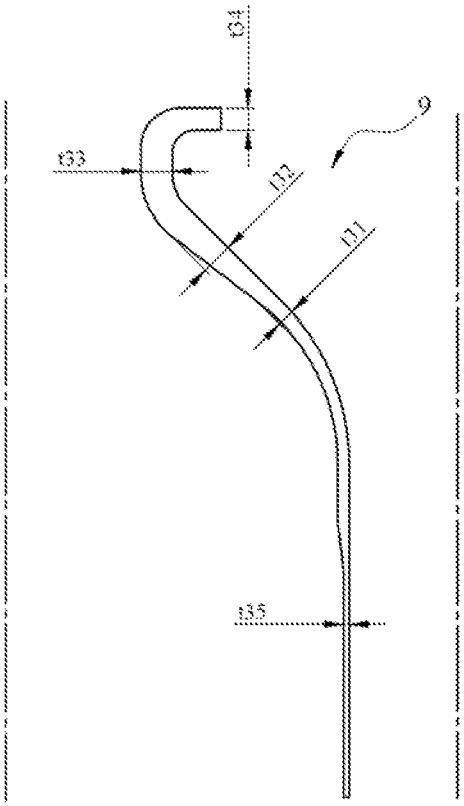
Figure 13:
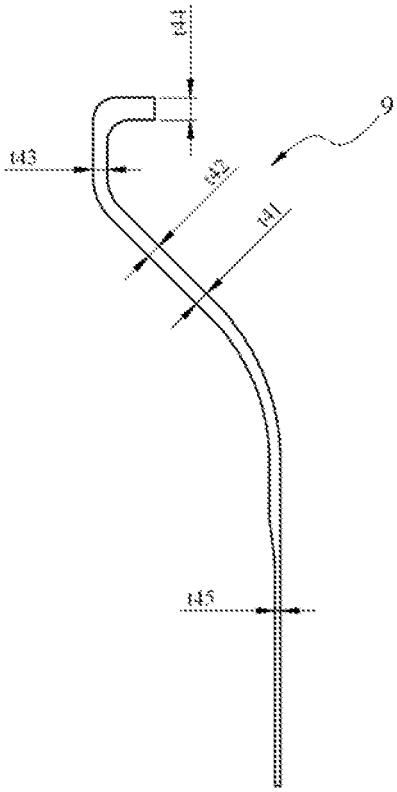

The subject of the invention is disclosed at the drawings, where FIG. 1 shows a punch known from the prior art, FIG. 2—its cross-section, FIG. 3 shows a punch according to the invention, FIG. 4-7 show a cross-sections of different variants of punches, FIG. 8 show a can in the form of a semi-finished can, FIG. 9 shows a cross-section of a thick wall known from the prior art, FIG. 10 shows a cross-section of a thick wall according to the invention, FIG. 11 shows a finished can, FIG. 12 shows a cross-section of can's neck known from the prior art, FIG. 13 shows a cross-section of can's neck according to the invention.

Example 1

Comparative Example

A punch known from the prior art has a cylindrical body 1 with a step 2 and a region forming a thick wall 3. The region 3 forming a thick wall in the standard solution is characterized by a constant diameter of the punch in the whole lengths L3 forming the profile. The profile of the section forming thick wall is defined by a straight line parallel to the axis of the punch. The step may have height from 0.1 to 200 μm, and length from 0.01 to 30 millimeters. The length of the L3, defining the thick wall, may vary from 1 to 100 millimeters.

The wall of the semi-finished can for the manufacture of the can after using the known punch in the upper area is thicker than the middle part (thick wall). This is to enable the operation of forming the neck and to ensure the appropriate thickness of the can flange for connection with the lid and making the so-called double seam. The middle part of the can has a wall thickness of 85-100 μm, and the upper in the range 100-250 μm. The thicknesses t11, t12 and t13 are equal to each other. Minimal differences are the result of the quality and tolerance of the tools. The ratio between the thickness t11 and t14 ranges from 0.3 to 0.9. The operation of necking the can causes inhomogeneous thickening of the material in the neck area 9. Depending on the thickness of the (input) raw aluminum sheet thickness, the wall thickness of the finished can neck t31 may range from 100 to 300 μm, while t32 and t33 from 120-350 μm. The thickness t35 remains unchanged in relation to the thickness t14 before the necking operation. The number of necking steps varies depending on the can design i.e. height, diameter, seaming diameter, neck shape and the necking device used. A description of the can neck necking process is given in, for example, U.S. Pat. Nos. 5,724,848A, 4,774,839A and 5,297,414A.

Figure 4:
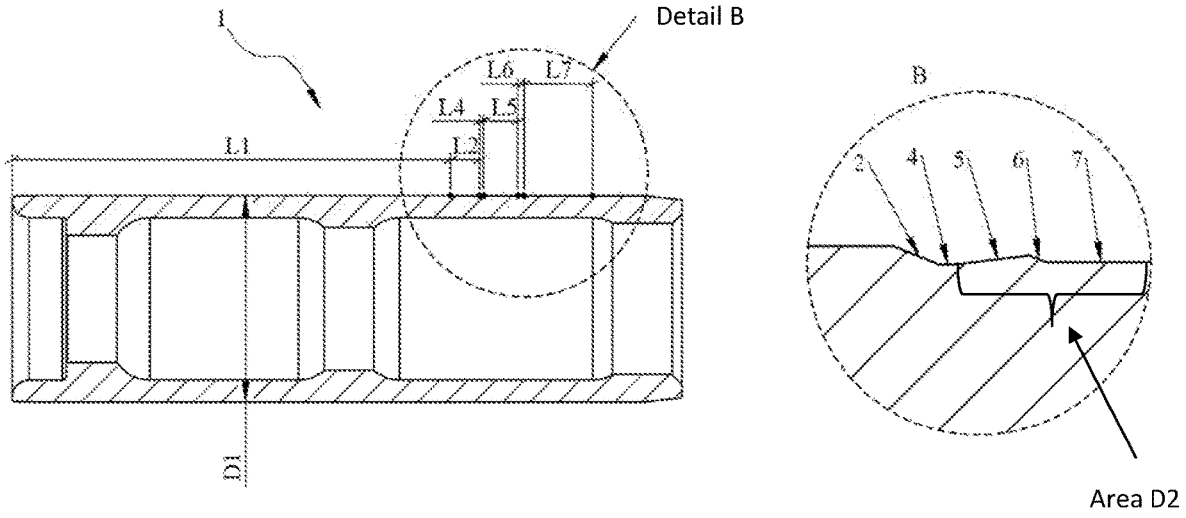

Example 2 (FIG. 4)

A punch comprises a cylindrical body, where the region forming can sidewall 1 has length 140.5 mm and diameter D1 equal to 60 mm. The step 2 has length 20 mm and height of 100 μm. The region 3 forming thick wall has length 28 mm, and has variable diameter D2. The region 3 forming thick wall consists of four sections. The first section 4 is parallel to the punch axis. The punch diameter D2 in this section is 59.9 mm. The length L4 is 2 mm. The second section 5 ma has length L5 equal to 10 mm. The diameter of the section 5 D2 increases linearly from 59.9 to 59.95 mm. The section 6 has length of L6 2 mm, and its diameter D2 decreases linearly from 59.95 to 59.9. The section 7 has length 14 mm and is parallel to the punch axis. The diameter D2 of the punch in this region is 59.9 mm.

Figure 5:
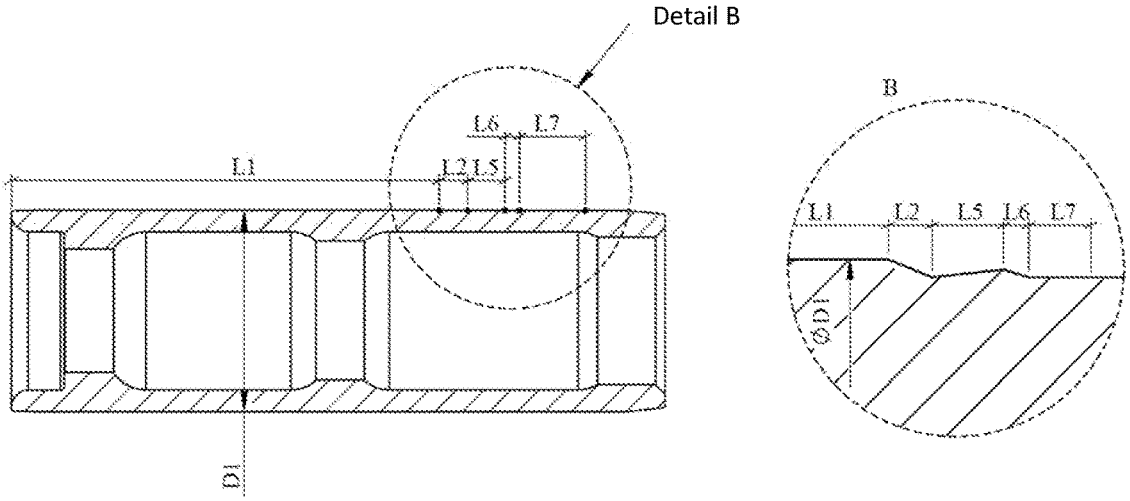

Example 3 (FIG. 5)

A punch comprises a cylindrical body, where the region forming can body has length 140 mm and diameter D1 equal to 60 mm. The step 2 has length 20 mm and height 30 μm. The region 3 forming thick wall has length 30 mm, and has variable punch diameter D2. The region 3 forming thick wall consists of three sections. The first section 5 has length L5 equal to 10 mm. The punch diameter D2 in the section 5 varies linearly from 59.97 to 59.986 mm. The second section 6 has length L6 of 2 mm, and the punch diameter D2 decreases linearly from 59.986 to 59.97. The section 7 has length 20 mm and is parallel to the punch axis. The diameter D2 of the punch in this region is 59.97 mm.

Example 4 (FIG. 6)

A punch comprises a cylindrical body, where the region forming can body 1 has length 140 mm and diameter D1 equal to 60 mm. The step 2 has length 20 mm and height 30 μm. The region 3 forming thick wall has length 30 mm, and has variable punch diameter D2. The region 3 forming thick wall consists of two sections. The first section 5 has length L5 equal to 11 mm. The punch diameter D2 in the section 5 varies linearly from 59.97 to 59.986 mm. The second section 6 has length L6 of 2 mm, and the punch diameter D2 decreases linearly from 59.986 to 59.97. The section 7 has length 20 mm and is parallel to the punch axis. The diameter D2 of the punch in this region is 59.97 mm.

Example 5 (FIG. 7)

A punch comprises a cylindrical body, where the region forming can body 1 has length 140 mm and diameter D1 equal to 60 mm. The step 2 has length 20 mm and height of 30 μm. The region 3 forming thick wall has length 30 mm, and has variable diameter D2. The region 3 forming thick wall consists of four sections. The first section 4 is parallel to the punch axis. The punch diameter D2 in this section is 59.97 mm. The length L4 is 100 μm. The second section 5 ma has length L5 equal to 10 mm. The diameter D2 of the section 5 varies linearly from 59.97 to 59.986 mm. The section 6 has length of L6 2.5 mm, and its diameter D2 varies linearly from 59.986 to 59.97. The section 7 has length 25 mm and is parallel to the punch axis. The diameter D2 of the punch in this region is 59.97 mm.

Example 6

A beverage can in the form of a semi-finished can for manufacturing a finished can of thick wall of variable thickness t24 equal to 80 μm, t23 equal to 170 μm, t22 equal to 30 μm and t21 equal to 180 μm.

Example 7

A beverage can in the form of a semi-finished can for manufacturing a finished can of thick wall of variable thickness t24 equal to 78 μm, t23 equal to 150 μm, t22 equal to 120 μm and t21 equal to 170 μm.

Example 8

A beverage can in the form of a semi-finished can for manufacturing a finished can of thick wall of variable thickness t24 equal to 90 μm, t23 equal to 180 μm, t22 equal to 135 μm and t21 equal to 190 μm.

Example 9

A beverage can in the form of a semi-finished can for manufacturing a finished can of thick wall of variable thickness t24 equal to 60 μm, t23 equal to 150 μm, t22 equal to 110 μm and t21 equal to 160 μm.

Example 10

A finished beverage can having a neck of a variable wall thickness, where the thickness t45 is equal to 80 μm, the thickness t41 is equal to 140 μm, the thickness t42 equal to 142 μm, the thickness t43 is equal to 146 μm, and the thickness t44 is equal to 170 μm.

Example 11

A finished beverage can having a neck of a variable wall thickness, where the thickness t45 is equal to 60 μm, the thickness t41 is equal to 120 μm, the thickness t42 equal to 122 μm, the thickness t43 is equal to 126 μm, and the thickness t44 is equal to 160 μm.

Example 12

A finished beverage can having a neck of a variable wall thickness, where the thickness t45 is equal to 65 μm, the thickness t41 is equal to 135 μm, the thickness t42 equal to 135 μm, the thickness t43 is equal to 140 μm, and the thickness t44 is equal to 160 μm.

Example 13

A finished beverage can having a neck of a variable wall thickness, where the thickness t45 is equal to 85 μm, the thickness t41 is equal to 140 μm, the thickness t42 equal to 135 μm, the thickness t43 is equal to 135 μm, and the thickness t44 is equal to 162 μm.

Example 14

A finished beverage can having a neck of a variable wall thickness, where the thickness t45 is equal to 65 μm, the thickness t41 is equal to 135 μm, the thickness t42 equal to 135 μm, the thickness t43 is equal to 135 μm, and the thickness t44 is equal to 160 μm.

The invention claimed is:

1. A punch for drawing beverage metal cans comprising
- a cylindrical body with a separated region (1) forming a can sidewall having a diameter D1,
- a step (2), and
- a region (3) forming a thick wall in an upper part of the beverage can wherein the region (3) forming the thick wall starts from the step (2), and wherein a diameter D2 of the punch in the region (3) is variable and is smaller than the diameter D1 of the region (1) forming the can's sidewall, wherein:
  - the region (3) forming a thick wall of the can has length smaller than 100 mm, the diameter D2 of the punch in the region-forming the thick wall of the can is in the range from 29.7 to 99.9 mm,
  - the diameter D1 of the punch in the region-forming the can sidewall is in the range from 30 to 100 mm,
  - the step has length (L2) from 0.1 to 40 mm, height from 1 to 500 μm, and an angle in relation to an axis of the punch from 1 to 80 degrees,
  - the step (2) is disposed between the separated region (1) and the region (3),
  - the region (3) forming a thick wall of the can comprises, in order, a first section (5) in which the diameter D2 increases, a second section (6) in which the diameter D2 decreases, and a third section (7) in which the diameter D2 is parallel to an axis of the punch, and
  - the first section (5) is closer to the step (2) than the third section (7).

2. The punch according to claim 1, wherein the first section (5) has length (L5) from 0.01 to 40 mm, and the third section 7 has length (L7) from 0.1 to 30 mm.

3. The punch according to claim 1, wherein the region (3) forming the thick wall of the can comprises a fourth section (4) having length (L4) from 0.05 to 40 mm, the section (5) has length (L5) from 0.01 to 40 mm, and the third section 7 has length (L7) from 0.1 to 30 mm.

4. The punch according to claim 1, wherein the first section (5) has length (L5) from 0.01 to 40 mm, the second section (6) has length (L6) from 0.1 to 30 mm, and the third section (7) has length (L7) from 0.1 to 30 mm.

5. The punch according to claim 1, wherein the region (3) forming the thick wall of the can comprises a fourth section (4) having length (L4) from 0.05 to 40 mm, the first section (5) has length (L5) from 0.01 to 40 mm, the second section (6) has length (L6) from 0.1 to 30 mm, and the third section (7) has length (7) from 0.1 to 30 mm.

6. The punch according to claim 1, wherein the diameter D2 of the punch in the region forming the thick wall of the can is smaller than the diameter D1 of the punch in the region forming the can body by at least 10 μm.

7. The punch according to claim 1 wherein the diameter D2 of the punch in the region forming the thick wall of the can varies linearly or/and non-linearly.

8. The punch according to claim 1, wherein the step (2) tapers inward toward the axis of the punch from D1 to D2.

9. The punch according to claim 1, wherein the region (3) forming a thick wall of the can comprises a fourth section (4) in which the diameter D2 is parallel to the axis of the punch, and wherein the fourth section (4) is disposed between the step (2) and the first section (5).

* * * * *